US009102453B2

(12) United States Patent
Koenigkramer

(10) Patent No.: US 9,102,453 B2
(45) Date of Patent: Aug. 11, 2015

(54) HIGH BURST PACKAGE HAVING A RECLOSABLE POUR SPOUT

(75) Inventor: Rusty Koenigkramer, Nanuet, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 630 days.

(21) Appl. No.: 12/649,785

(22) Filed: Dec. 30, 2009

(65) Prior Publication Data

US 2010/0202714 A1 Aug. 12, 2010

Related U.S. Application Data

(60) Provisional application No. 61/152,097, filed on Feb. 12, 2009.

(51) Int. Cl.

| | |
|---|---|
| ***B65D 33/16*** | (2006.01) |
| ***B65D 33/20*** | (2006.01) |
| ***B65D 33/02*** | (2006.01) |
| ***B65D 33/00*** | (2006.01) |
| ***B65D 75/58*** | (2006.01) |
| ***B65D 30/20*** | (2006.01) |
| ***B65D 33/25*** | (2006.01) |

(52) U.S. Cl.

CPC ..... *B65D 75/5822* (2013.01); *B65D 31/10* (2013.01); *B65D 33/2508* (2013.01); *B65D 33/2533* (2013.01); *B65D 33/2566* (2013.01); *B65D 2575/586* (2013.01)

(58) Field of Classification Search

CPC ..... B65D 33/2533; B65D 33/2541
USPC ..... 383/63, 120, 61.2, 34, 95
See application file for complete search history.

(56) References Cited

U.S. PATENT DOCUMENTS

| | | | | |
|---|---|---|---|---|
| 4,787,880 | A | 11/1988 | Ausnit | |
| 4,792,240 | A | 12/1988 | Ausnit | |
| 4,878,987 | A | 11/1989 | Ven Ergen | |
| 4,929,225 | A | 5/1990 | Ausnit et al. | |
| 5,692,837 | A * | 12/1997 | Beer | 383/210.1 |
| 5,782,733 | A | 7/1998 | Yeager | |
| 5,829,884 | A | 11/1998 | Yeager | |
| 5,938,339 | A * | 8/1999 | Ouchi | 383/63 |
| 5,954,433 | A | 9/1999 | Yeager | |
| 6,082,897 | A * | 7/2000 | Galomb | 383/63 |
| 6,132,089 | A * | 10/2000 | Galomb et al. | 383/63 |
| 6,186,663 | B1 * | 2/2001 | Ausnit | 383/63 |
| 6,234,676 | B1 * | 5/2001 | Galomb et al. | 383/63 |
| 6,572,267 | B1 | 6/2003 | Forman | |
| 6,805,485 | B2 * | 10/2004 | Hogan et al. | 383/64 |
| 6,971,794 | B2 | 12/2005 | Yeager | |
| 6,986,920 | B2 * | 1/2006 | Forman et al. | 428/34.1 |
| 6,993,886 | B2 | 2/2006 | Johnson | |
| 7,040,810 | B2 | 5/2006 | Steele | |
| 7,144,159 | B2 * | 12/2006 | Piotrowski et al. | 383/64 |
| 7,442,156 | B2 | 10/2008 | Yeager | |
| 2004/0058103 | A1 * | 3/2004 | Anderson et al. | 428/34.1 |

(Continued)

*Primary Examiner* — Jes F Pascua
*Assistant Examiner* — Derek Battisti
(74) *Attorney, Agent, or Firm* — McCarter & English, LLP

(57) ABSTRACT

The disclosure relates to a gusseted reclosable package with an internal unisex reclosure strip. The reclosure strip has upper and lower flanges, and a two or three-point connection, rather than a four-point connection, to the interior circumference of the package. This results in the package having a higher internal (product side) opening strength than the external (consumer side) opening strength, thereby allowing the package to be easily opened by the consumer while maintaining a high burst strength.

22 Claims, 5 Drawing Sheets

(56) References Cited

U.S. PATENT DOCUMENTS

2007/0021285 A1* 1/2007 Hinesley ..... 493/394
2007/0086683 A1* 4/2007 Yeager ..... 383/95
2007/0130733 A1 6/2007 Kasai
2007/0297698 A1 12/2007 Berich
2008/0008404 A1* 1/2008 Brauer et al. ..... 383/61.1
2008/0008406 A1 1/2008 Russell et al.
2008/0240625 A1* 10/2008 McCracken et al. ..... 383/64

* cited by examiner

HIGH BURST PACKAGE HAVING A RECLOSABLE POUR SPOUT

This application claims priority under 35 U.S.C. §119(e) of U.S. provisional application Ser. No. 61/152,097 filed Feb. 12, 2009, the disclosure of which is hereby incorporated by reference.

BACKGROUND OF THE INVENTION

1. Field of the Disclosure

The present disclosure pertains to a gusseted reclosable package with a high burst strength and a reclosable pour spout. More particularly, the high burst strength is achieved by a two or three-point connection of the zipper, typically a unisex zipper, to the package walls.

2. Description of the Prior Art

A representative prior art package having a reclosable pour spout is disclosed in U.S. Pat. No. 6,971,794 issued on Dec. 6, 2005 and U.S. Pat. No. 7,442,156, issued on Oct. 28, 2008, both entitled "Package Having Reclosable Pour Spout and Method of Forming Same" and issued to Yeager. Such a package typically uses a unisex reclosure which is defined as a single tape that will mate or close to different sections of itself not requiring a male/female or otherwise differing zipper halves. The reclosure, comprising a single tape, is applied to the film by sealing both edges of the zipper to the film in the location where the gusset is formed. Therefore, upon opening the package or bag, a reclosable gusset is created which can act as a pour spout. The methods and apparatus typically used to apply the reclosure to the film are found in U.S. Pat. No. 5,782,733 issued on Jul. 21, 1998 and U.S. Pat. No. 6,177,172 issued on Jan. 23, 2001, both entitled "Zippered Film and Bag", and issued to Yeager. Other prior art includes U.S. Pat. No. 7,040,810 entitled "Flexible Package with a Transverse Access Panel Device", issued on May 9, 2006 to Steele; U.S. Pat. No. 4,929,225 entitled "Method of Making Bags and Bag Material Having Hinged Zipper Strips", issued on May 29, 1990 to Ausnit; and U.S. Pat. No. 4,792,240 entitled "Extruded Zipper Strips for Bags" issued on Dec. 20, 1988 to Ausnit.

A typical zipper for this application is shown in FIG. 1. This zipper is a variable alignment, double-track zipper with a flange on both sides (i.e., upper and lower flanges). Because the zipper is symmetrical, the internal opening force is typically equal to the external opening force. While this is certainly acceptable for some applications, there are other applications in which it would be preferable to allow the customer to open the package with a relatively lower opening force while providing a reclosable package and zipper which can resist relatively greater internal force required for heavier loads. In other words, easy opening on the consumer side along with high burst strength on the product side may be desired.

Similarly, in gusseted applications, due to the mass of the zipper, it is difficult to fold the zipper fully on itself and stay closed, in the area of the gusset fold.

OBJECTS AND SUMMARY OF THE DISCLOSURE

It is therefore an object of the present disclosure to provide a reclosable package or bag, with the capability of including a gusset, and further providing a relatively lower external consumer-side opening force and a relatively higher internal product-side opening force.

This and other objects are obtained by providing a reclosable package or bag with a unisex reclosure strip which is attached by a two or three-point seal, thereby omitting at least part of the seal between the product-side flanges and the package walls. The reclosure strip is typically a two-flange symmetrical unisex zipper in order to reduce camber and to allow zipper introduction from either side of the manufacturing apparatus.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
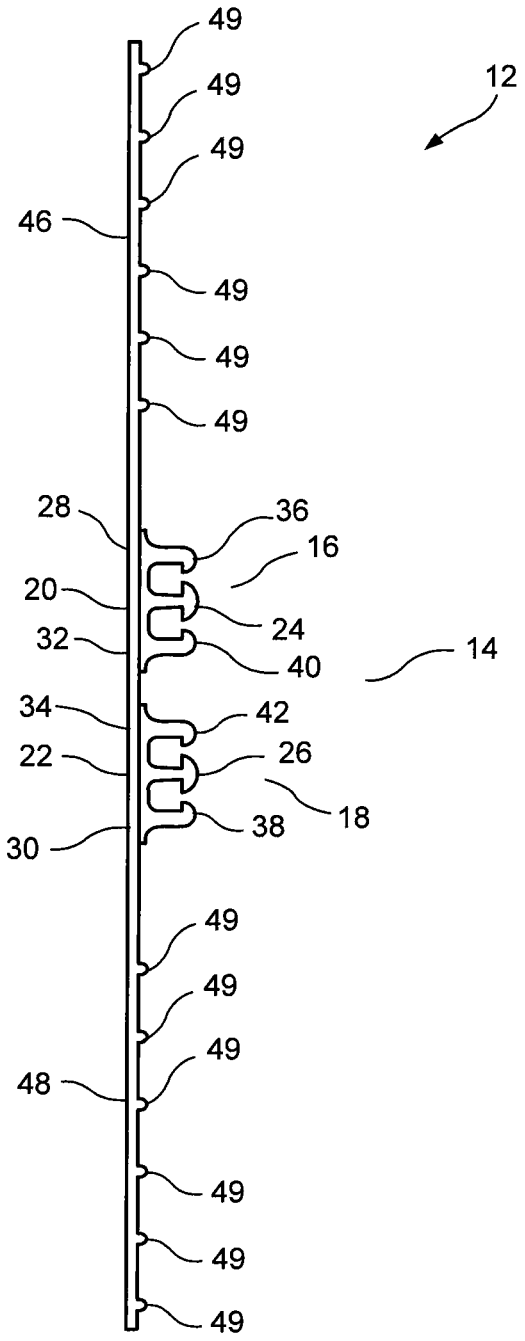
F I G. 1 PRIOR ART
FIG. 1 is a cross-sectional view of a prior art unisex reclosure strip. This reclosure strip can be incorporated into the present disclosure.
Figure 2:
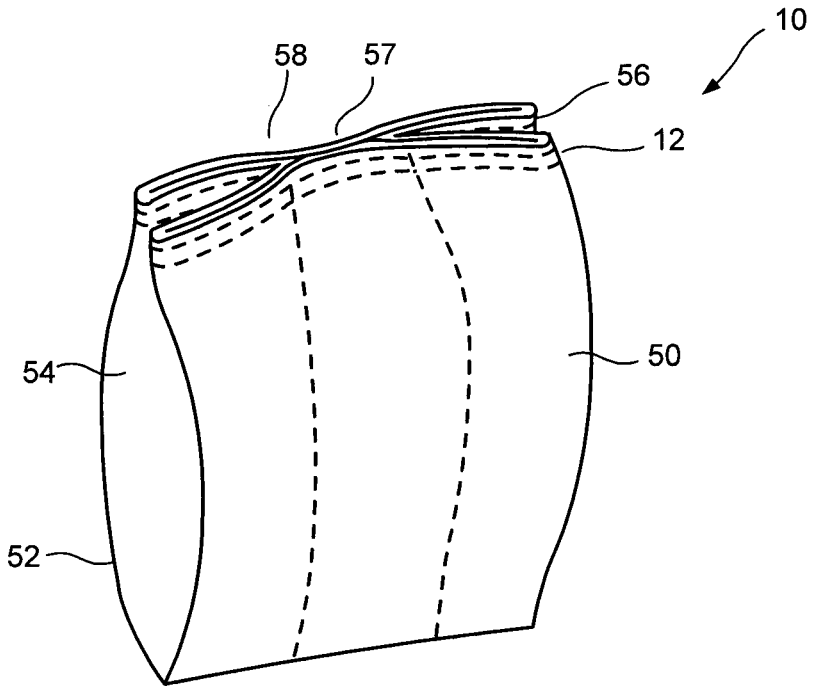
FIG. 2 is a perspective view of a first embodiment of the gusseted package of the present disclosure.
Figure 3:
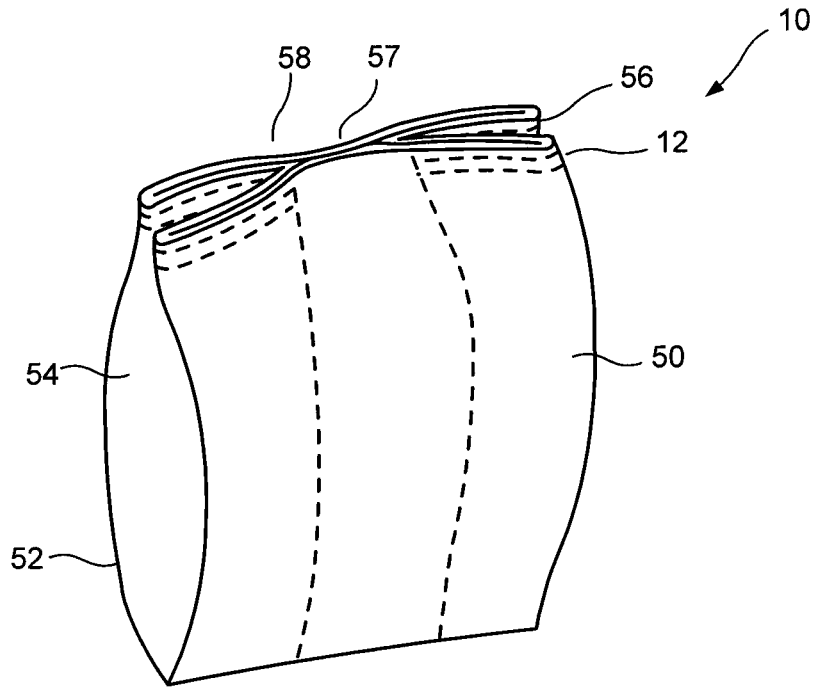
FIG. 3 is a perspective view of a second embodiment of the gusseted package of the present disclosure

Referring now to the drawings in detail wherein like numerals indicate like elements throughout the several views, one sees that FIG. 1 is a typical prior art reclosure strip or zipper 12 which can be used with the disclosed gusseted reclosable package or bag 10 of FIGS. 2 and 3. Reclosure strip 12 includes central symmetric interlocking element 14 comprising first and second engagement assemblies 16, 18. First engagement assembly 16 includes a central post 20 with a bulbous head 24, and further includes lateral arms 28, 32 adjacent to central post 20, with respective distal hooked ends 36, 40 oriented toward central post 20. Second engagement assembly 18 is substantially identical to first engagement assembly 16, includes a central post 22 with a bulbous head 26, and further includes lateral arms 30, 34 adjacent to central post 22, with respective distal hooked ends 38, 42 oriented toward central post 22. Upper (consumer-side) flange 46 extends upwardly from first engagement assembly 16 while lower (product-side) flange 48 extends downwardly from second engagement assembly 18. Reclosure strip 12 can interlock with different sections of the same strip, due to the unisex and variable alignment characteristics of first and second central engagement assemblies 16, 18. Upper and lower product flanges 46, 48 include offsets 49 to prevent or minimize the unintended sealing of the outer surface (illustrated on FIG. 1 as the right side of the reclosure strip 12) of the upper and lower product flanges 46, 48 to an opposing surface.

Figure 4:
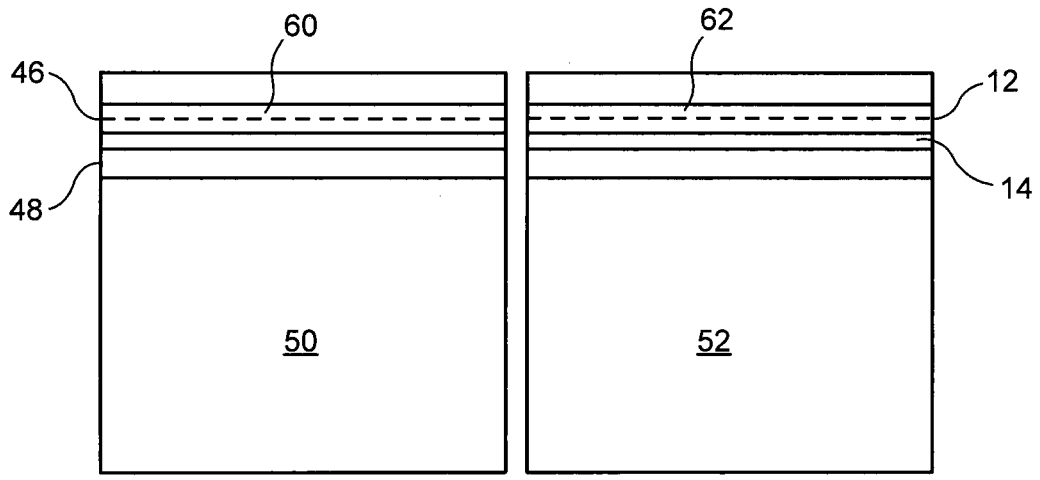
FIG. 4 is a diagram of a two-point seal as used in the present disclosure.
Figure 5:
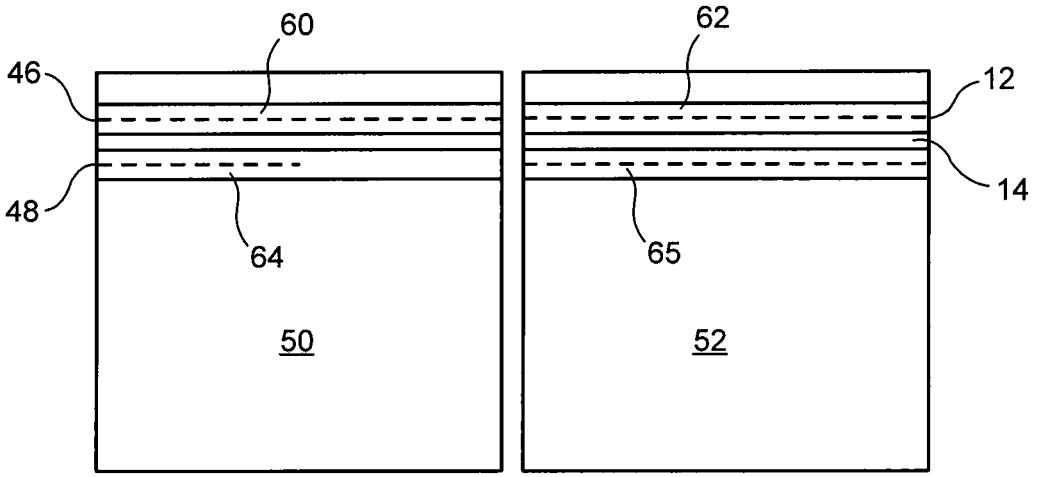
FIG. 5 is a diagram of a three-point seal as used in the present disclosure.

A first embodiment of gusseted bag 10 according to the present disclosure is illustrated in FIG. 2. Gusseted bag 10 includes a front wall 50 and a rear wall 52 with first gusset 54 along a first side and second gusset 56 along a second side. Mouth 58 is formed along an open top end or edge of gusseted bag 10. A single strip of reclosure strip 12, illustrated in phantom, is sealed to a circumferential interior of front and rear walls 50, 52 as well as first and second gussets 54, 56 downwardly adjacent from mouth 58. First and second gussets 54, 56 are illustrated in a closed configuration, but may also be in an open configuration to form first and second pour spouts. A two or three-point seal is used to seal reclosure strip 12 to the interior of the gusseted bag 10 as illustrated in FIGS. 4 and 5. The mouth of the embodiment of the gusseted bag 10 of FIG. 2 typically extends along the entire top edge of front and rear walls 50, 52 with no sealing of the front and rear walls 50, 52 to each other in the central region 57. In contrast, the embodiment of gusseted bag of FIG. 3 includes sealing of the front and rear walls 50, 52 to each other in the central region 57. Due to this sealing, the reclosure strip 12 can be omitted below central region 57 while remaining in the interior of first and second gussets 56, 58.

FIG. 4 illustrates a two-point seal. The front and rear walls 50, 52 (or first and second gussets 54, 56 in the case of the embodiment of FIG. 3) are illustrated as being side-by-side with reclosure strip 12 sealed thereto downwardly adjacent from the top or mouth 58. Upper (consumer-side) flange 46 is sealed to the entire inner circumference of the package 10, including front and rear walls 50, 52 as well as first and second gussets 54, 56, along front and rear upper hard seal lines 60, 62, respectively, illustrated as dotted lines. However, no seal line is formed between the lower (product-side) flange 48. The presence of two hard seal lines 60, 62 is the basis of the term "two-point" sealing, as opposed to conventional "four-point" sealing wherein both the upper and lower flanges 46, 48 are sealed to both the front and rear walls 50, 52.

FIG. 5 illustrates a three-point seal. As in FIG. 4, the front and rear walls 50, 52 (or first and second gussets 54, 56 in the case of the embodiment of FIG. 3) are illustrated as being side-by-side with reclosure strip 12 sealed thereto downwardly adjacent from the top or mouth 58 thereof. Front and rear upper hard seal lines 60, 62 are formed as in FIG. 4. However, in the illustrated three-point sealing of FIG. 5, the first lower hard seal line 64 is formed only between a portion of the length of the lower flange 48 along front wall 50 and the inner circumference of the package 10 formed by the front and rear walls 50, 52 as well as first and second gussets 54, 56 (with another portion of the length of lower flange 48 being free of sealing to the inner circumference, including front and rear walls 50, 52 as well as first and second gussets 54, 56). A shortened bottom seal bar (not shown) is required for the first lower hard seal line 64. Second lower hard seal line 65 extends along the entire length of the lower flange 48 along rear wall 52. Of course, first and second lower hard seal lines 64, 65 may be reversed with respect to front and rear walls 50, 52. The three-point seal of FIG. 5 may be advantageous to the two-point seal of FIG. 4 in that product contents are less likely to get caught behind a free flange.

Figure 6:
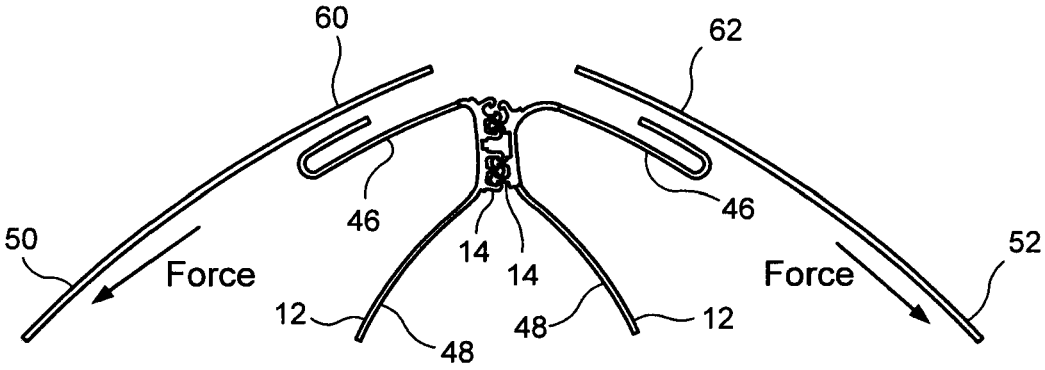
FIG. 6 is a diagram illustrating the effects of an internal force on the two-point seal of the present disclosure.
Figure 8:
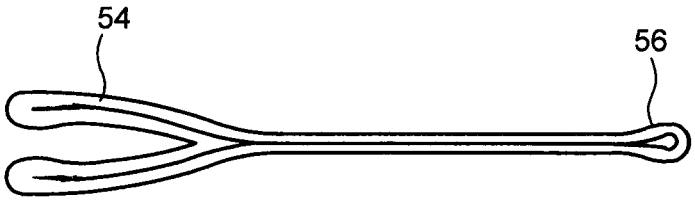
FIG. 8 is an illustration of a folded-out partially open gusset.
Figure 7:
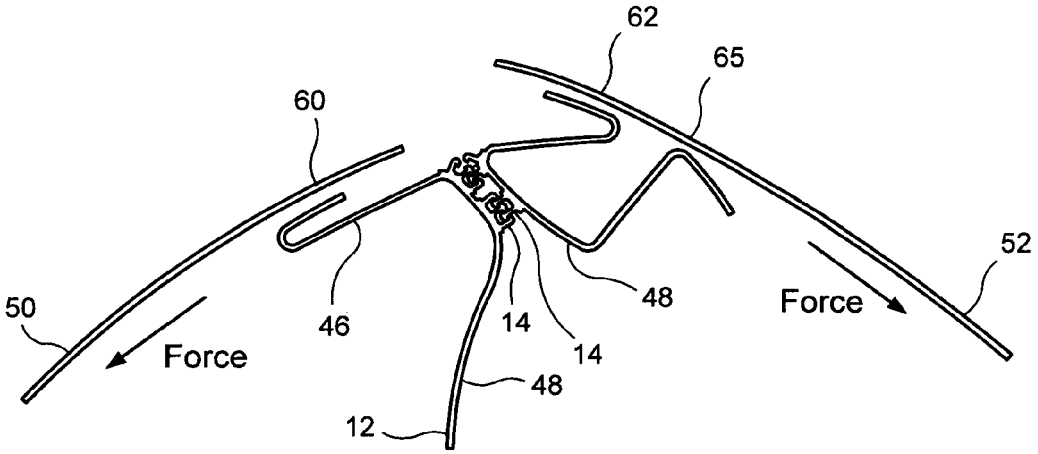
FIG. 7 is a diagram illustrating the effects of an internal force on the three-point seal of the present disclosure.
Figure 9:
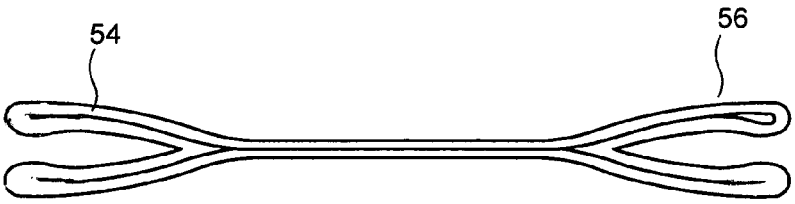
FIG. 9 is an illustration of a closed gusset, with a partially open portion.

The configurations of FIGS. 4 and 5 cause the internal (product-side) opening force to increase, as an internal force will cause the opposed upper flanges 46 to align with each other as shown in FIGS. 6 and 7 (corresponding to FIGS. 4 and 5, respectively), thereby causing a shear force, rather than a peeling force, on the first and second engagement assemblies 16, 18. In other words, in a three-point seal, the interior (product side) forces are directed to the hinge or fold above the interlocking elements thereby placing the zipper in a horizontal mode so that the separating forces pull on the interlocking elements of the zipper in opposite directions. Additionally, with the prior art four-point seal, the reclosure strip or zipper is prone to opening because the zipper profile becomes partially distorted at the folded-in innermost point, the folded-in outer point and the folded-out outer point of the gussets. Therefore, the disclosed two and three-point seals result in a more robust connection when a gusset is partially open, such as second gusset 56 as shown in FIGS. 8 and 9 (equally applicable to first gusset 54).

A typical comparison of the internal and external opening forces for three and four-point sealing is illustrated below:

| | 4-point design (prior art) | 3-point design | Comments |
|---|---|---|---|
| Consumer Side Opening Force | 1.3 | 1.3 | Pounds to open one inch sample |
| Internal Opening Force | 1.3 | 6.8 | Pounds to open a one inch sample |
| Shake Test (fully closed) | 3 | 10+ | Shakes to failure using 900 grams of frozen french fries |
| Shake Test (gusset partially open) | 2 | 10+ | Shakes to failure using 900 grams of frozen french fries |

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable package comprising:

a front wall and a rear wall;

a first gusset formed between a first edge of the front wall and a first edge of the rear wall;

a single reclosure tape extending around an interior of the first gusset, the reclosure tape including a first flange and a second flange; and wherein the first flange is sealed to the interior of the first gusset and the second flange is free of sealing to a portion of the interior of the first gusset; and wherein the first flange is sealed to a circumferential interior of the front wall, rear wall, and first gusset, and wherein a first portion of the second flange is sealed to substantially an entire length of a first of the front wall and rear wall and to a first portion of a second of the front wall and rear wall, and wherein a second portion of the second flange is free of sealing.

2. The reclosable package of claim 1 further including a second gusset formed between a second edge of the front wall and a second edge of the rear wall.

3. The reclosable package of claim 2 wherein the reclosure tape extends around an interior of the package, including the front wall and the rear wall.

4. The reclosable package of claim 3 wherein a mouth is formed at a top edge of the front wall and the rear wall.

5. The reclosable package of claim 4 wherein the reclosure tape includes a central interlocking element, wherein the first flange extends from the central interlocking element toward the mouth and the second flange extends from the central interlocking element away from the mouth.

6. The reclosable package of claim 5 wherein the reclosure tape can interlock with different segments of itself.

7. The reclosable package of claim 6 wherein an internal force in the reclosable package results in a shear force on the central interlocking elements which are interlocked with each other.

8. The reclosable package of claim 7 wherein the reclosure tape can interlock along a variation of alignments.

9. The reclosable package of claim 8 wherein the first gusset and the second gusset can be configured as respective first and second pour spouts.

10. The reclosable package of claim 9 wherein the first and second pour spouts can be configured as partially open.

11. The reclosable package of claim 10 wherein the central locking element includes a first locking assembly and a second locking assembly.

12. A reclosable package comprising:

a front wall and a rear wall;

a first gusset formed between a first edge of the front wall and a first edge of the rear wall;

a single reclosure tape extending around an interior of the first gusset, the reclosure tape including a first flange and a second flange;

wherein the first flange is sealed to an interior of the first gusset and the second flange is sealed to a first portion of the interior of the first gusset and is free of sealing to a second portion of the interior of the first gusset; and wherein the first flange is sealed to a circumferential interior of the front wall, rear wall, and first gusset, and wherein a first portion of the second flange is sealed to substantially an entire length of a first of the front wall and rear wall and to a first portion of a second of the front wall and rear wall, and wherein a second portion of the second flange is free of sealing.

13. The reclosable package of claim 12 further including a second gusset formed between a second edge of the front wall and a second edge of the rear wall.

14. The reclosable package of claim 13 wherein the reclosure tape extends around an interior of the package, including the front wall and the rear wall.

15. The reclosable package of claim 14 wherein a mouth is formed at a top edge of the front wall and the rear wall.

16. The reclosable package of claim 15 wherein the reclosure tape includes a central interlocking element, wherein the first flange extends from the central interlocking element toward the mouth and the second flange extends from the central interlocking element away from the mouth.

17. The reclosable package of claim 16 wherein the reclosure tape can interlock with different segments of itself.

18. The reclosable package of claim 17 wherein an internal force in the reclosable package results in a shear force on the central interlocking elements which are interlocked with each other.

19. The reclosable package of claim 18 wherein the reclosure tape can interlock along a variation of alignments.

20. The reclosable package of claim 19 wherein the first gusset and the second gusset can be configured as respective first and second pour spouts.

21. The reclosable package of claim 20 wherein the first and second pour spouts can be configured as partially open.

22. The reclosable package of claim 21 wherein the central locking element includes a first locking assembly and a second locking assembly.

* * * * *